US006840172B2

(12) United States Patent
Toyama

(10) Patent No.: US 6,840,172 B2
(45) Date of Patent: Jan. 11, 2005

(54) MULTIPLE-SEAL-FACED STAMP OF LIQUID-EXUDING TYPE

(75) Inventor: Tetsuyuki Toyama, Gamagohri (JP)

(73) Assignee: Yamahachi Kemikaru Kabushiki Kaisha (JP)

( * ) Notice: Subject to any disclaimer, the term of this patent is extended or adjusted under 35 U.S.C. 154(b) by 213 days.

(21) Appl. No.: 10/101,078

(22) Filed: Mar. 19, 2002

(65) Prior Publication Data

US 2002/0144614 A1 Oct. 10, 2002

(51) Int. Cl.[7] ..... B41K 1/56

(52) U.S. Cl. ..... 101/405; 101/334

(58) Field of Search ..... 101/405, 406, 101/368, 375, 376, 334, 333, 327, 316

(56) References Cited

U.S. PATENT DOCUMENTS

| | | | | | |
|---|---|---|---|---|---|
| 3,880,079 | A | * | 4/1975 | Klapholz | 101/334 |
| 4,805,529 | A | * | 2/1989 | Becher | 101/334 |
| 4,852,489 | A | * | 8/1989 | Wall et al. | 101/334 |
| 5,359,932 | A | * | 11/1994 | Van Breene | 101/334 |
| 5,740,737 | A | * | 4/1998 | Polak et al. | 101/334 |
| 5,850,787 | A | * | 12/1998 | Pichler | 101/105 |
| 6,453,813 | B1 | * | 9/2002 | Faber | 101/405 |

FOREIGN PATENT DOCUMENTS

| | | |
|---|---|---|
| JP | 1158908 | 3/1999 |

* cited by examiner

*Primary Examiner*—Anthony H Nguyen
(74) *Attorney, Agent, or Firm*—Price, Heneveld, Cooper, DeWitt & Litton, LLP

(57) ABSTRACT

A stamp of liquid-exuding type has a multiple-seal-faced assembly adapted for stamping with selected one of these multiple faces, preferably for stamping with multiple colors.

7 Claims, 13 Drawing Sheets

MULTIPLE-SEAL-FACED STAMP OF LIQUID-EXUDING TYPE

BACKGROUND OF THE INVENTION

A stamp of liquid-exuding type having a multiple-seal-faced assembly has previously been developed by the inventor and the applicant of the present invention. In this prior art stamp, a seal with multiple faces is rotatably supported by a handle so that the lowest face of the seal may be stamped on paper by pressing the handle downward. The assembly including the seal faces is rotated so that the next seal face is moved to the lowest position as the handle is moved upward after being pressed downward (Japanese Laid-Open Patent Application No. 1999-58908).

Assembly of multiple different seal faces in known multiple-seal-faced stamp of liquid-exuding type is supported by a handle of the type which is usually used for a numbering stamp. This handle is usually in the form of a gate-shaped frame which is supported in a vertically movable manner. In general, such gate-shaped frames should be made of a high structural strength material to withstand the forces applied to the handle in use. Thus, such handles are commonly made of metallic material, disadvantageously leading to unacceptably high cost.

SUMMARY OF THE INVENTION

One aspect of the present invention is a multiple seal faced stamp of the liquid-exuding type including an outer housing a through-hole at the bottom thereof. The stamp includes a multiple seal face assembly of the liquid-exuding type, an inner housing rotatably supporting this assembly, and a spring loaded depressable handle biased into an upper position and operatively coupled to the inner housing. The multiple seal face assembly is adapted to be depressed downward and returned upward together with the inner housing within the outer housing. The multiple seal face assembly, the inner housing and the handle are supported by the outer housing with the handle projecting upward from the outer housing. The outer housing includes a driving pin on its inner surface providing a mechanism to rotate the multiple seal face assembly. The multiple seal face assembly includes a plurality of driving slits on both side walls thereof. Each driving slit is oriented radially around a central shaft and constitutes also the mechanism to rotate the multiple seal face assembly. The driving pin is adapted to extend through a through-hole of the inner housing into engagement with one of the driving slits as the multiple seal face assembly moves upward from the lowest position thereof to the highest position thereof. This engagement causes the multiple seal face assembly to rotate by one seal face. The outer housing, inner housing and depressing handle are preferably molded from synthetic resin. The side wall of the multiple seal face assembly opposed to the side wall formed with said driving slits and the inner housing include a click-stop mechanism so that the rotation of the multiple seal face assembly can be reliably sensed. Furthermore, the respective seal face members of the multiple seal face assembly are impregnated with different colored ink to provide a multicolored stamp.

DETAILED DESCRIPTION OF THE PREFERRED EMBODIMENTS

Figure 1:
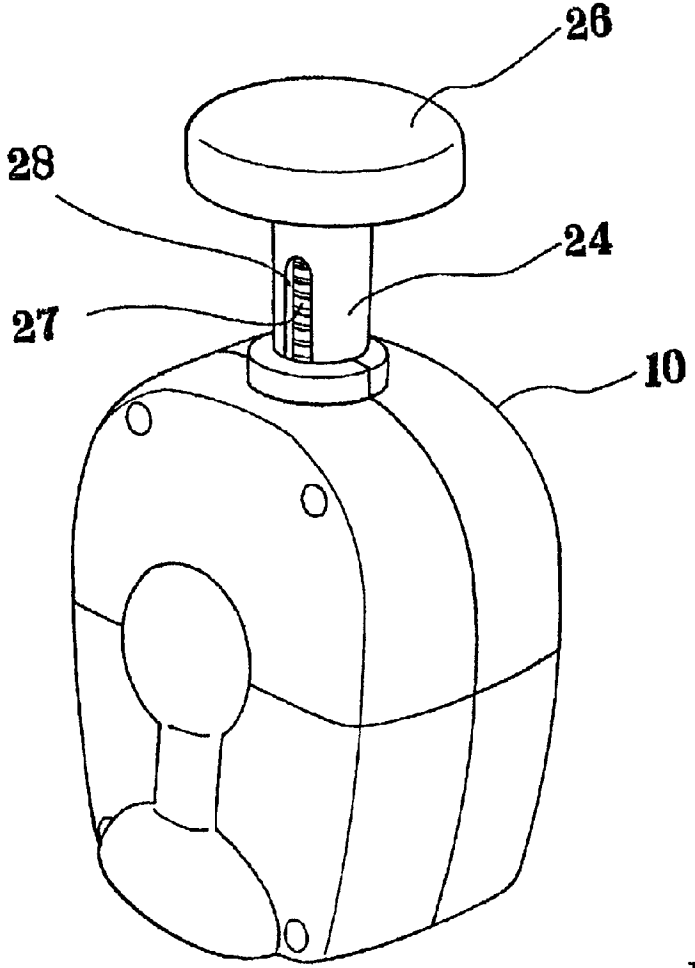
FIG. 1 is a perspective view showing an embodiment of a stamp of liquid-exuding type according to the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
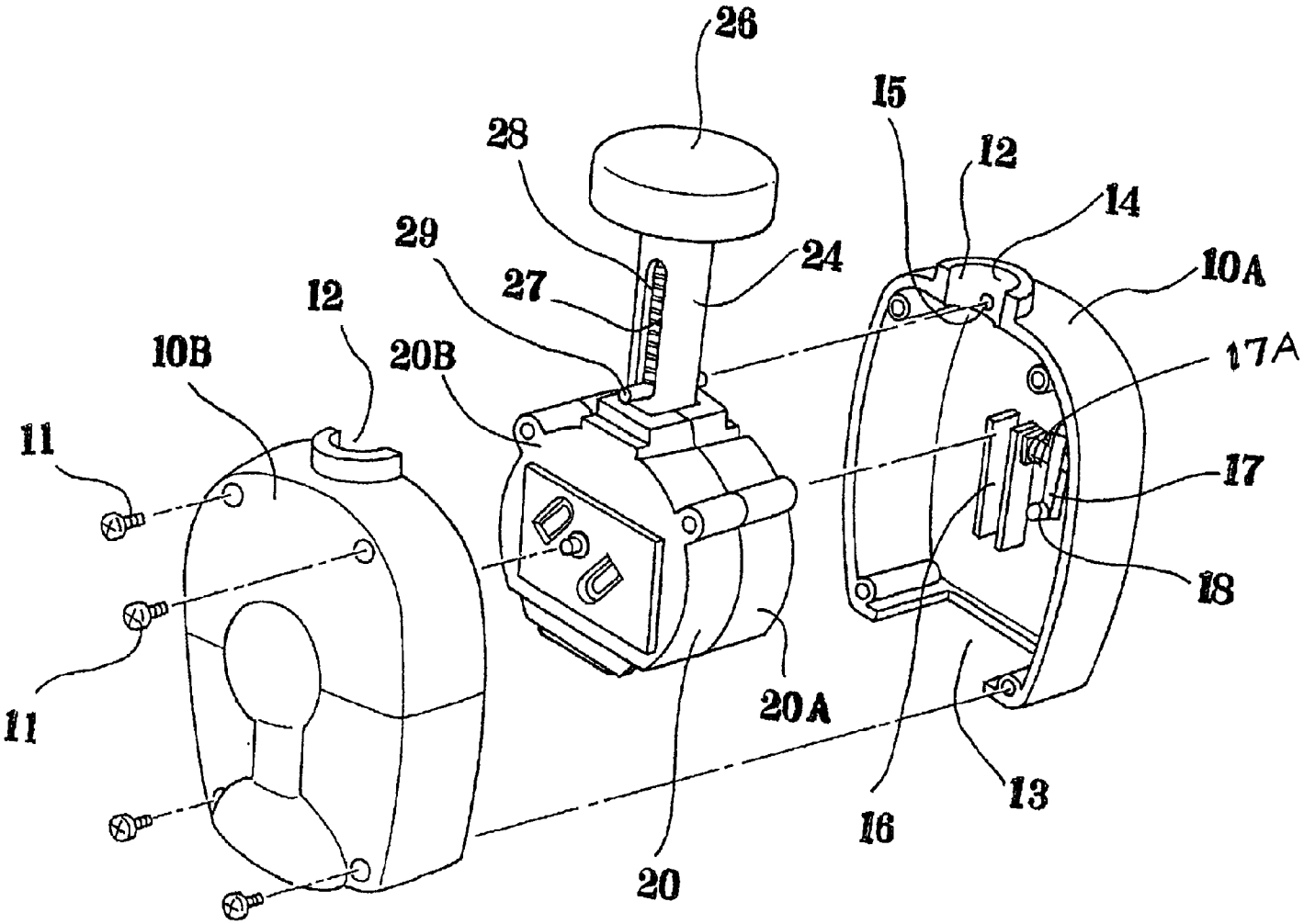
FIG. 2 is an exploded perspective view showing the stamp of FIG. 1 with the outer housing halves separated from each other.

Reference numeral 10 (FIGS. 1, 2) designates an outer housing 10 having a window 13 at the bottom thereof for stamping. The outer housing 10 includes separable front and rear, or right and left housing halves 10A, 10B which assembled into the complete outer housing 10 by means of screws 11. The top of outer housing 10 includes a through-hole 12 to guide a depressing handle which is described in detail below. Inner walls 14 of the outer housing halves 10A, 10B include recesses 15 adapted to receive opposite ends of a set pin to support a lower end of a spring that biases the depressing handle upwardly. The central portions of inner walls 14 of the outer housing halves 10A, 10B include a shaft guide 16 comprising pairs of vertically extending parallel guide plates that guide a central shaft that extend horizontally through the multiple seal face assembly of liquid-exuding type which is described in detail below. An arm 17 is pivotably mounted adjacent the inner wall of the outer housing half 10A by the side of the shaft guide 16. A spring 17A biases arm 17 to rotate inward. A driving pin 18 on arm 17 projects inwardly from the forward end of arm 17. The driving pin 18 cooperates with the multiple seal face assembly of liquid-exuding type to rotate the multiple seal face assembly of liquid-exuding type. The forward end of driving pin 18 is obliquely oriented so that its forward end can be disengaged from cooperating means described in detail below as the multiple seal face assembly of liquid-exuding type is lowered. Outer housing halves 10A, 10B are preferably molded from synthetic resin.

Figure 3:
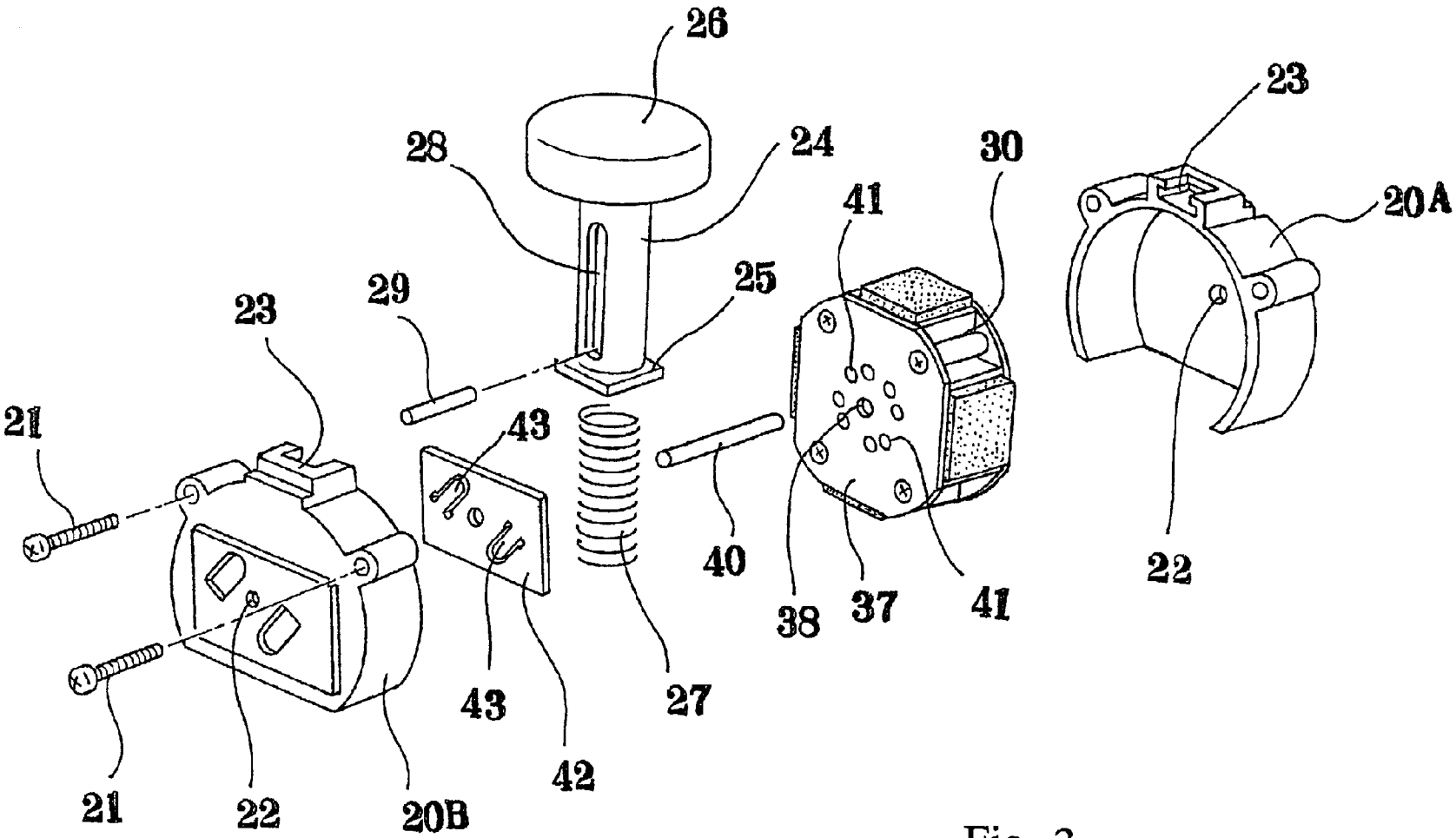
FIG. 3 is an exploded perspective view of the stamp with the inner housing and handle disassembled.
Figure 4:
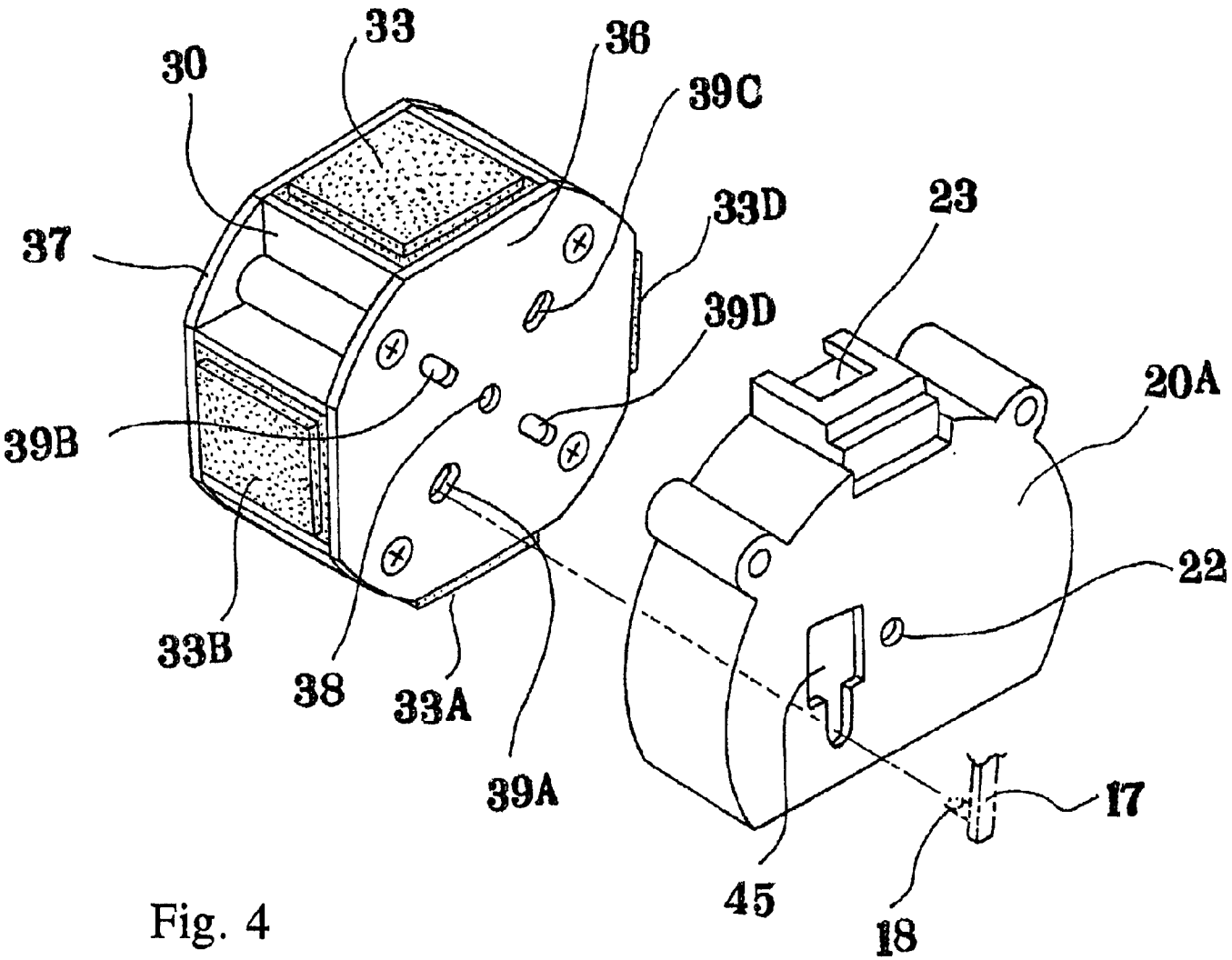
FIG. 4 is an exploded perspective view illustrating the mechanism that rotates the multiple seal face assembly of the stamp of FIG. 1.

Reference numeral 20 (FIG. 2) designates an inner housing that rotatably supports and encloses the multiple seal face assembly of liquid-exuding type described below. As discussed above, inner housing 20 is separable into inner housing halves 20A, 20B which are assembled to form the complete inner housing 20 by means of screws 21, 21. Central portions of inner housing halves 20A, 20B include bearing holes 22, 22 (FIG. 3) for supporting the previously described central shaft of the multiple seal face assembly of liquid-exuding type. The inner housing halves 20A, 20B include recesses 23 that receive a square plate 25 that defines a lower end of the depressing handle 24 couples the depressable handle 24 to the inner housing 20. Depressable handle 24 is a hollow cylindrical member having an upper end with a grip 26 and an open lower end through which a spring 27 is received. Handle 24 is includes a pair of longitudinally extending opposed slits 28. During assembly, a set pin 29 is inserted into the handle 24 across the lower ends of the slits 28. Opposite ends of set pin 29 are received in the recesses 15 formed in the inner walls 14 of the upper through-hole 12 of outer housing halves 10A, 10B. This arrangement enables the handle 24 to be selectively moved down and upward with a restoring elasticity biasing handle 24 upwardly. The inner housing halves 20A, 20B and handle 24 are also preferably molded from synthetic resin.

Figure 8:
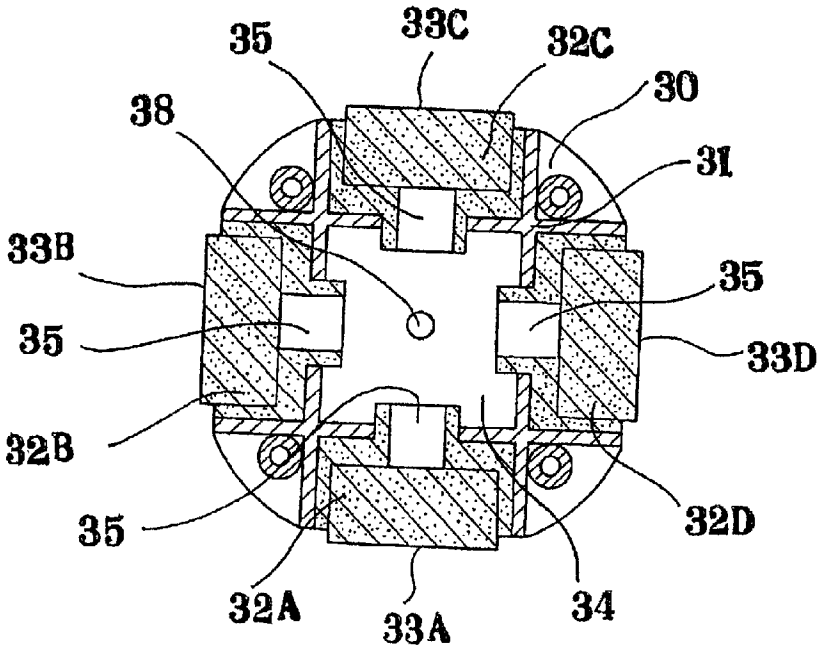
FIG. 8 is a sectional view showing the multiple seal face assembly.
Figure 7:
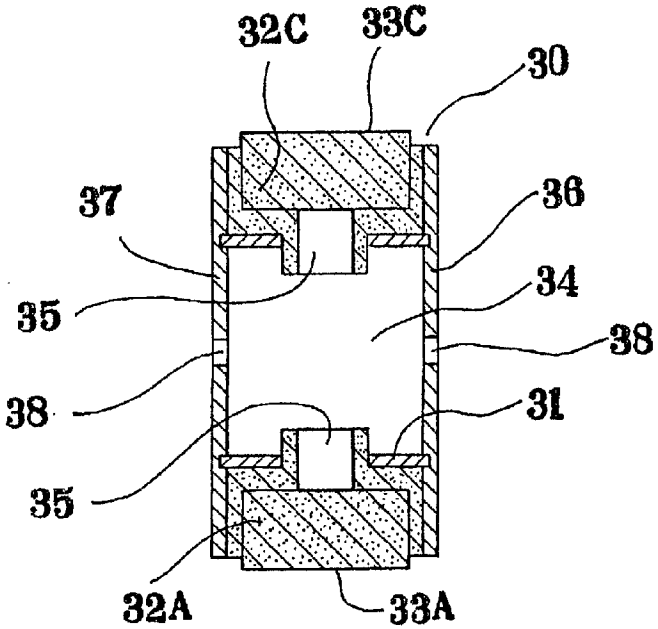
FIG. 7 is a sectional view showing the multiple seal face assembly.

Multiple seal face assembly of liquid-exuding type 30 (FIGS. 7, 8) includes a hollow frame 31 and four seal face members 32A, 32B, 32C, 32D set in four end surfaces of the hollow frame 31. The seal face members include seal faces 33A, 33B, 33C, and 33D. Each of the seal face members 32 is formed of a thermoplastic resin foam and includes a stamp ink passage 35 that is open to a central cavity 34 of the frame 31. Each seal face member may be impregnated with different colored ink to provide multicolored stamping.

Side plates 36, 37 are secured to both sides of face assembly 30 by screws. Side plates 36, 37 include a bearing bore 38 through the central portions thereof. The central shaft 40 is inserted into the bearing bores 38, and opposite ends of the central shaft 40 are received by the bearing recesses 22 formed on the inner housing halves 20A, 20B to rotatably support the multiple seal face assembly 30.

Figure 5:
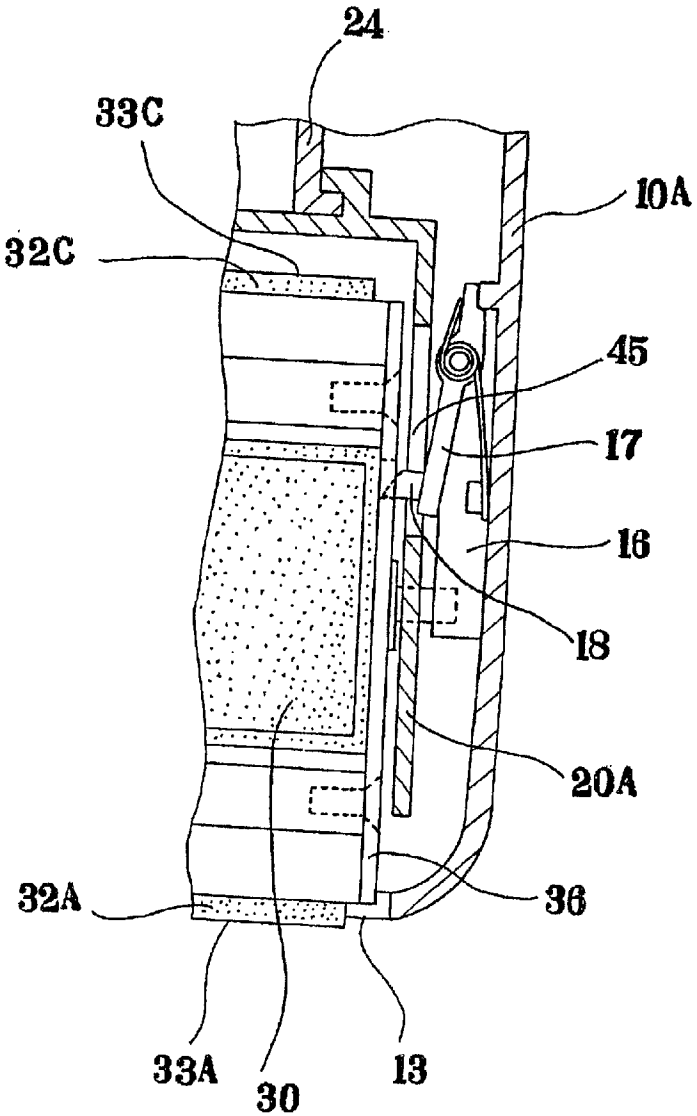
FIG. 5 is a sectional view showing the mechanism that rotates the multiple seal face assembly.
Figure 9:
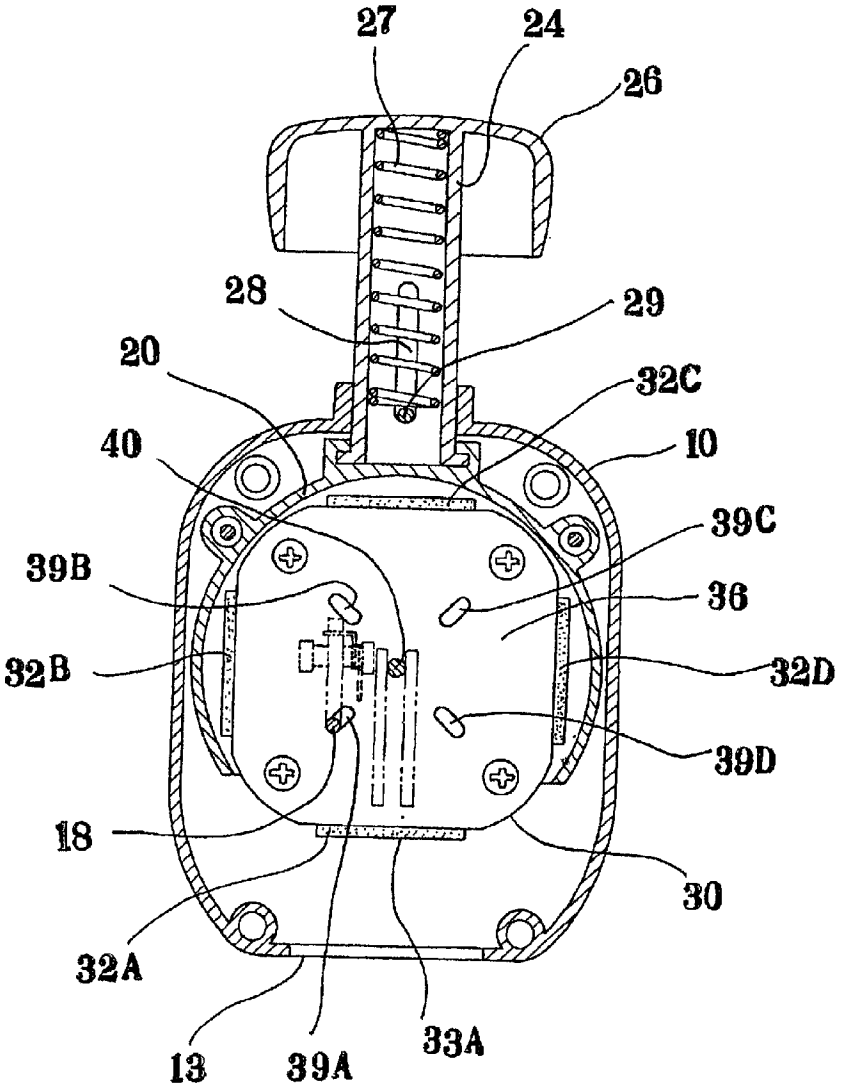
FIG. 9 is a fragmentary sectional view illustrating a first step in the operation of the mechanism to rotate the multiple seal face assembly.

With further reference to FIG. 9, when assembled the side wall 36 of face assembly 30 is located adjacent the outer housing half 10A (see also FIG. 5). Side wall 35 includes a plurality of driving slits 39A, 39B, 39C, 39C, 39D oriented radially around the central shaft 40 so that a selected one of these driving slits can be engaged with the driving pin 18. Inner housing half 20A includes a through-hole 45 to permit the driving pin 18 to come into engagement with the selected driving slit.

Figure 6:
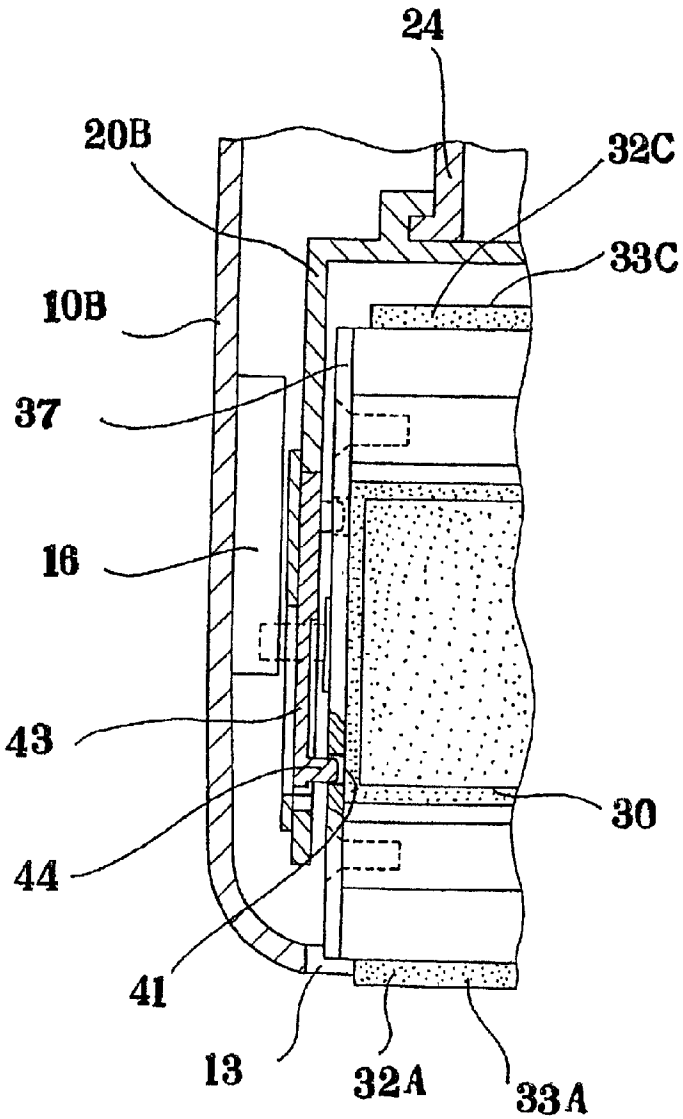
FIG. 6 is a sectional view showing the mechanism that click-stops further rotation of the multiple seal face assembly.

The other side plate 37 is formed with a plurality of stopper holes 41 (FIGS. 3 and 6) arranged in a circular pattern around the bearing bore 38 so as to constitute a click-stopper mechanism. These stopper holes 41 are adapted to receive click-projections 44 mounted on inner sides of distal ends of leaf springs 43 that are elastically deformed inward from a click-stopper plate 42 mounted on the inner wall of the other inner housing half 20B.

The stamp may be assembled as follows. First, the central shaft 40 is inserted into the bearing bore 38 of the multiple seal face assembly 30 having side plates 36, 37 secured thereto by screws. The click-stopper plate 42 is disposed between the side plate 37 and the other inner housing half 20B. Then, the inner housing halves 20A, 20B are put together with the multiple seal face assembly received therebetween, with the opposite ends of the central shaft 40 received in the bearing bores 22 of the respective inner housing halves 20A, 20B. At the same time, the spring 27 is inserted into the depressing handle 24 and the set pin 29 is placed under the lower end of the spring 27. The square plate 25 defining the lower end of the handle 24 is inserted into the handle supporting recesses 23 of the inner housing halves 20A, 20B. Housing halves 20A and 20B are then assembled by means of screws 21.

The inner housing 20 enclosing the multiple seal face assembly 30 with handle 24 may be assembled into the outer housing 10 as follows: The half 10A of the outer housing 10 is placed so as to face the half 20A of the inner housing 20, and the other half 10B of the outer housing 10 is placed facing the other half 20B of the inner housing 20. The outer housing halves 10A, 10B are then brought adjacent each other to enclose the inner housing 20 therebetween. Opposite ends of the set pin 29 are positioned at the lower end of the spring 27 within the depressing handle 24. The opposite ends of set pin 29 are then inserted into the associated receiving recesses 15 formed in the inner wall of the upper through-hole 12 defined by upper parts of the outer housing halves 10A, 10B. The outer housing halves 10A, 10B are then secured to each other by means of screws 11.

With reference to FIGS. 9–13, the multiple seal faced stamp of liquid-exuding type according to the present invention operates as follows. In the assembled state illustrated in FIG. 9, the multiple seal face assembly of liquid-exuding type 30 is supported around the central shaft 40 within the inner housing 20 and biased upwardly by spring 27. Consequently, the multiple seal face assembly 30 is retained together with the inner housing 20 at the higher position within the outer housing 10. In this state, the seal face member 32A occupies the lower most position, and its seal face 33A faces downward.

Figure 10:
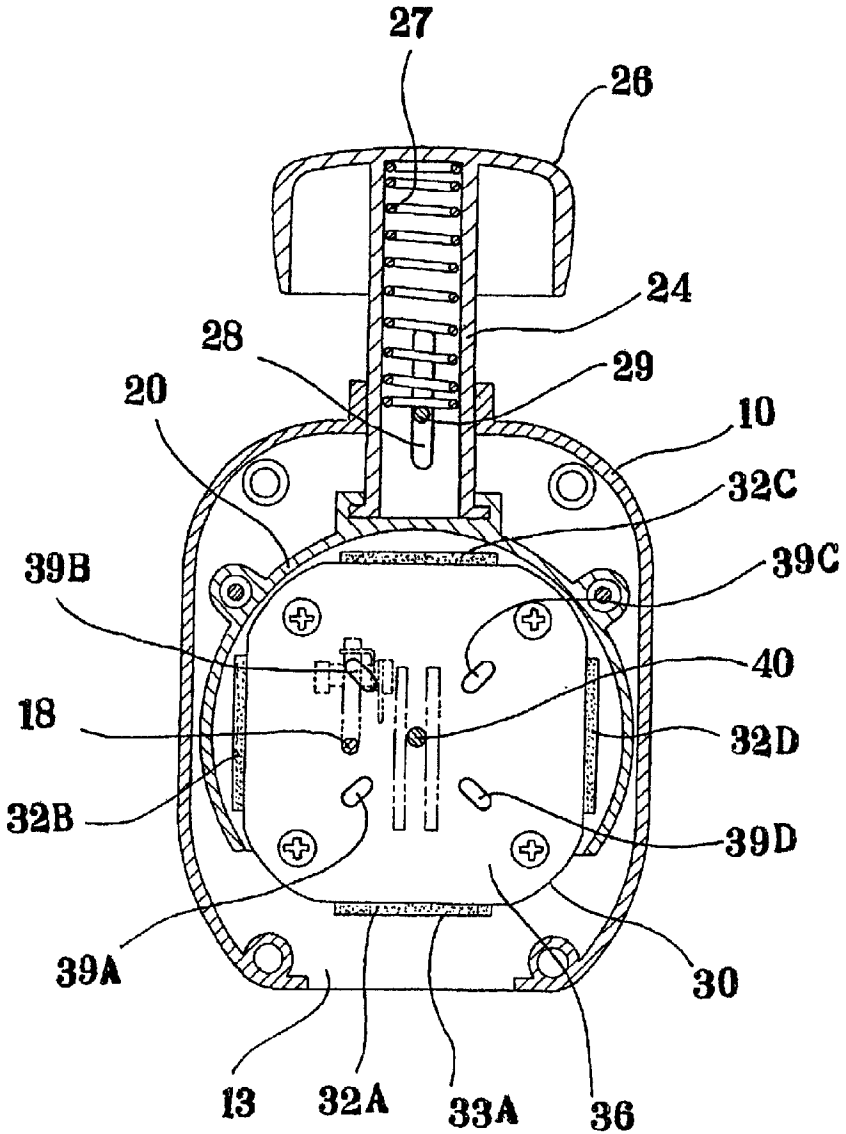
FIG. 10 is a fragmentary sectional view illustrating a second step in the operation of the mechanism to rotate the multiple seal face assembly.

Depression of the handle 24 from this state against the force of the spring 27 causes the multiple seal face assembly 30 to be moved downward together with the inner housing 20 without being rotated. During lowering of handle 24, the set pin 18 is disengaged from the associated driving slit 39A and comes in contact with the surface of the side wall 36 (FIG. 10).

Figure 11:
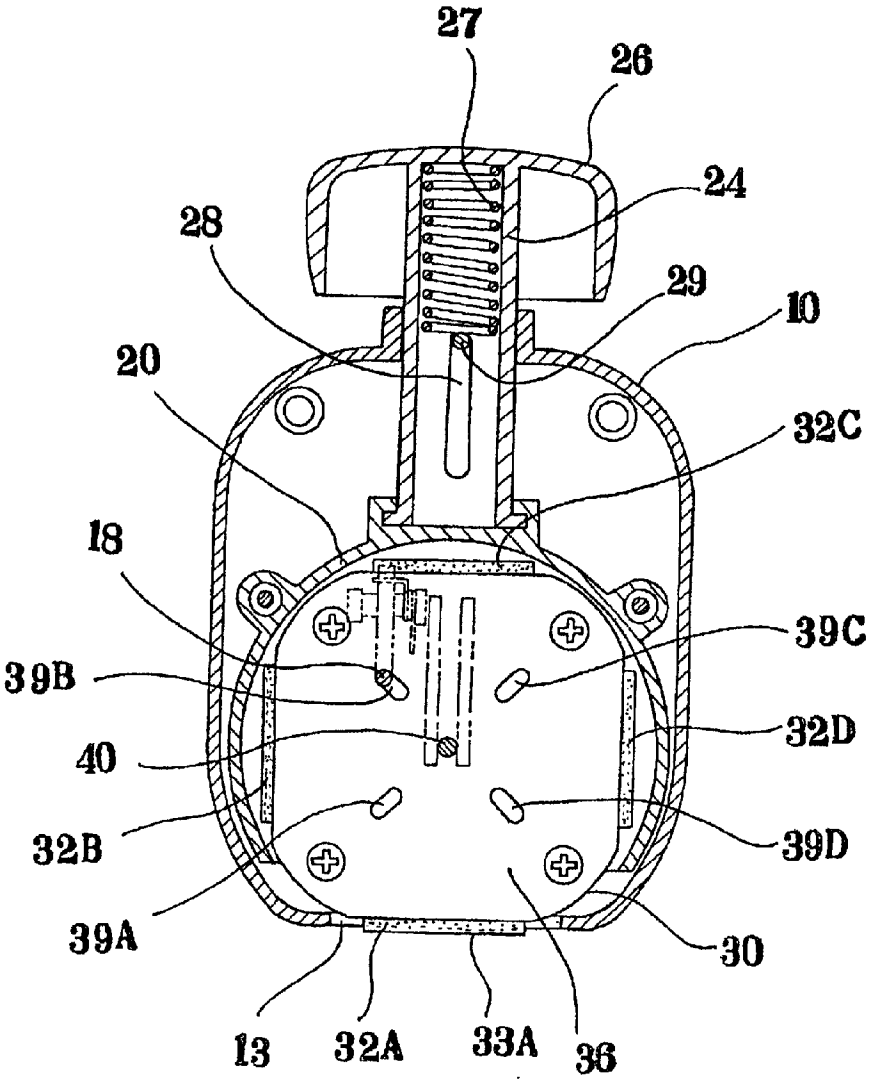
FIG. 11 is a fragmentary sectional view illustrating a third step in the operation of the mechanism to rotate the multiple seal face assembly.
Figure 12:
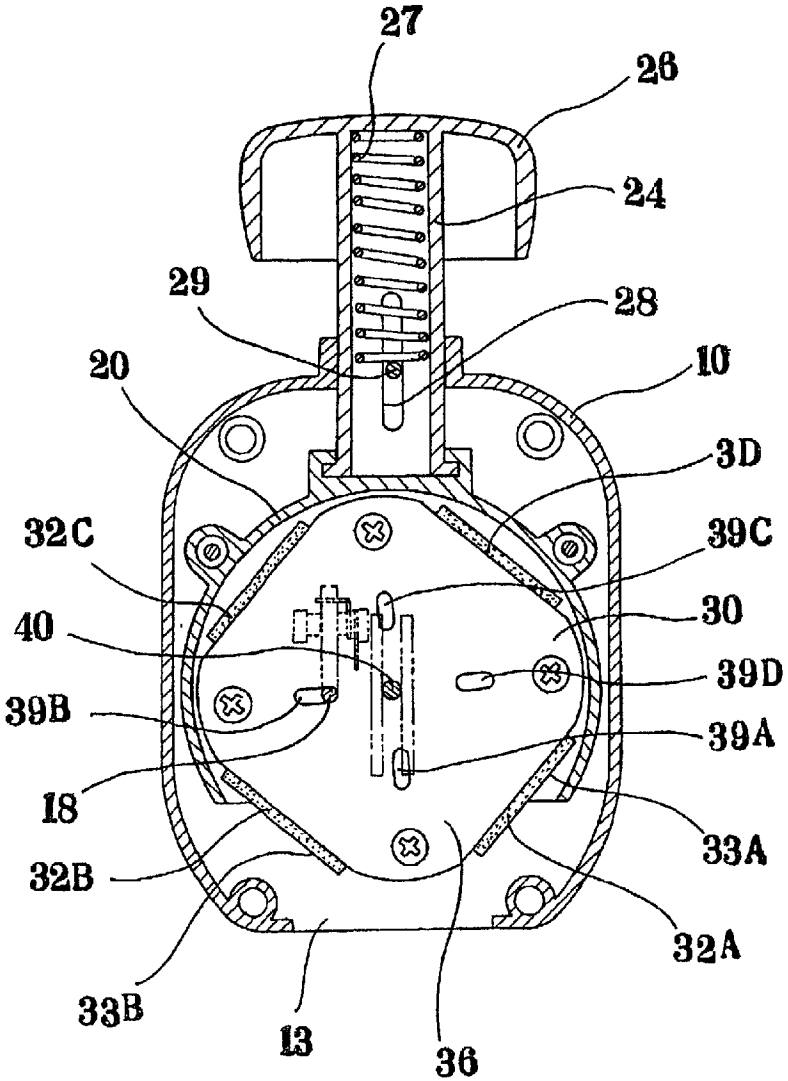
FIG. 12 is a fragmentary sectional view illustrating a fourth step in the operation of the mechanism to rotate the multiple seal faced assembly.

Upon depression of the assembly 30 together with the inner housing 20 down to the lowest position, the seal face 33A of the lowest seal face member 32A comes in contact with a paper sheet to be stamped through the window-like opening 13, and the seal face 33A of the seal face member 32A is stamped thereon. Thereupon, the driving pin 18 is engaged with the next driving slit 39B (FIG. 11).

Figure 13:
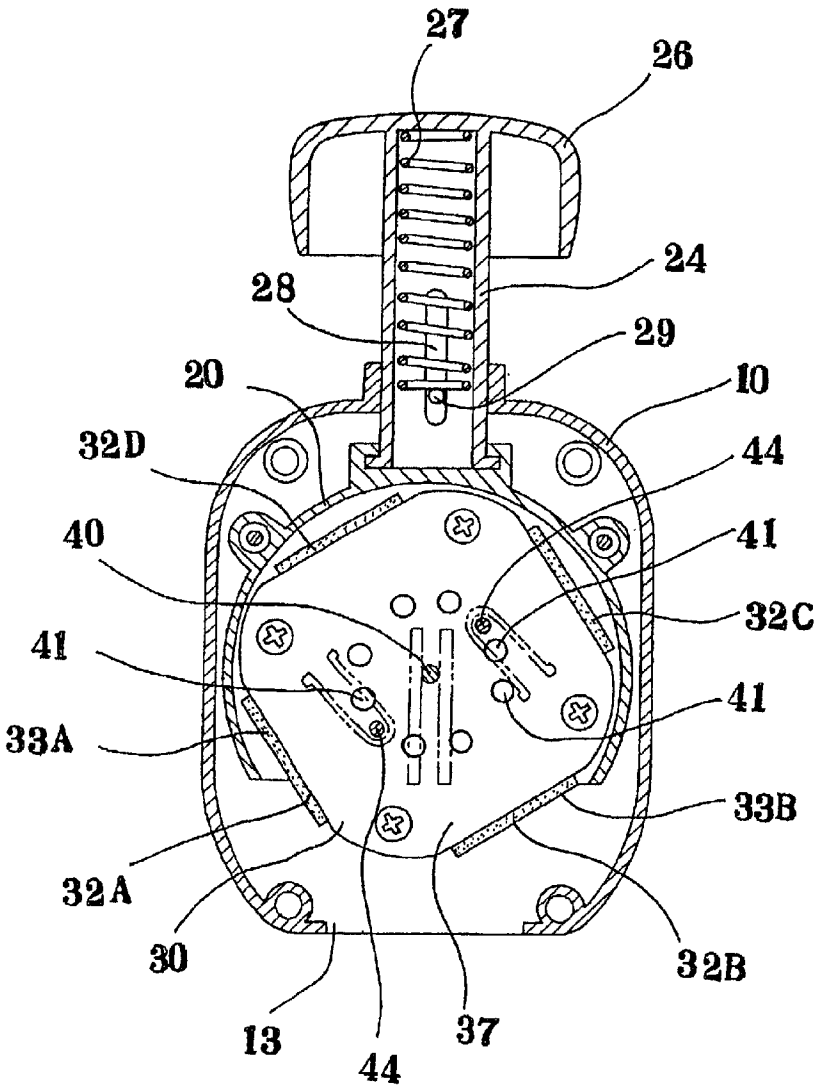
FIG. 13 is a fragmentary sectional view illustrating the operation of the click-stopper mechanism that click-stops the multiple seal face assembly immediately prior to the fourth step.
Figure 14:
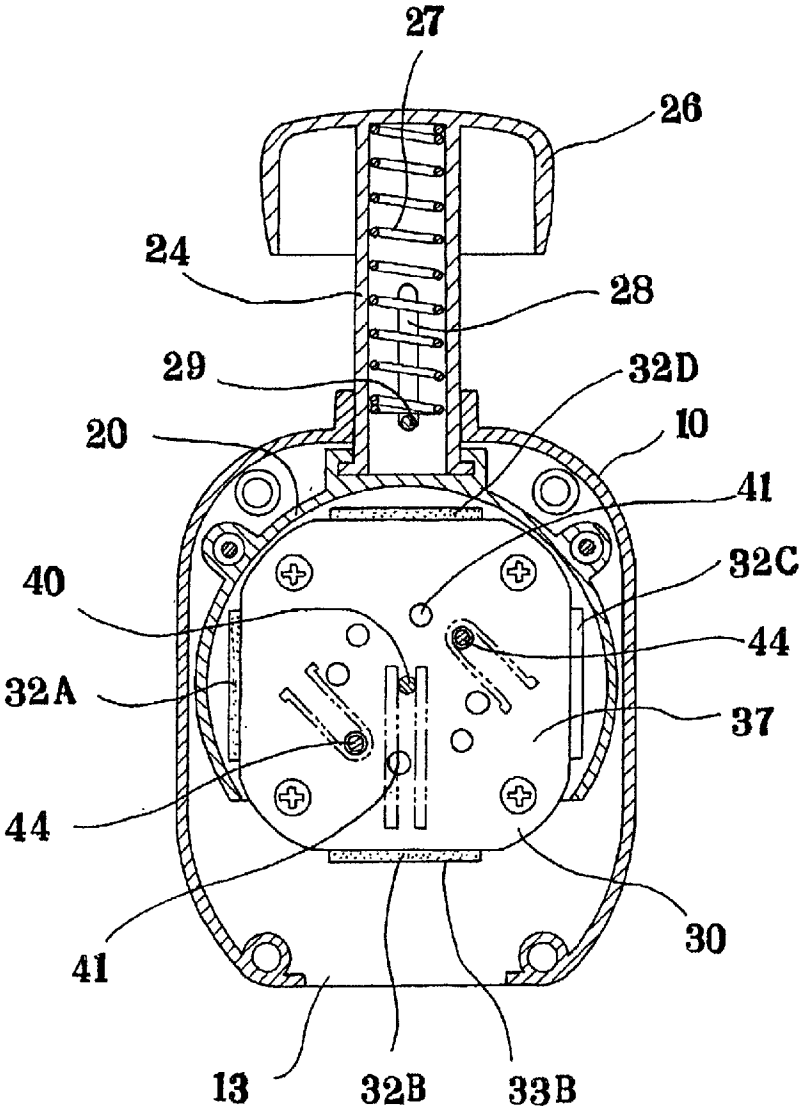
FIG. 14 is a fragmentary sectional view illustrating the fourth step in the operation of the click-stopper mechanism to click-stop the multiple seal face assembly.

When the force on handle 24 is released, the handle 24, the inner housing 20, and the multiple seal face assembly 30 are lifted together by the force of the spring 27. During such lifting back, the driving slit 39B remains in engagement with the driving pin 18 so that the multiple seal face assembly 30 is rotated around the central shaft 40 counterclockwise as viewed in FIG. 11 as the multiple seal face assembly 30 is lifted (FIG. 12) until the multiple seal face assembly 30 arrives at the highest position. Thereupon, the next seal face member 32B occupies the lowest position and its seal face 33B faces downward. At the same time, the click-projections 44 formed on leaf springs forming the click-stopper mechanism that were in contact with the side wall 37 are inserted into the stopper holes 41 and click-stop occurs (FIGS. 13 and 14).

The handle 24 may be depressed four times in this manner to stamp the respective seal faces 33A, 33B, 33C and 33D of four seal face members 32A, 32B, 32C and 32D on the same region of the sheet, thereby providing a multicolored stamp if the respective seal face members are impregnated with different colored ink.

In summary, the multiple seal faced stamp of liquid-exuding type according to this invention comprises the outer housing having a through-hole at its bottom, the multiple seal face assembly of liquid-exuding type, the inner housing rotatably supporting this assembly and the depressing handle loaded with restoring elasticity and operatively coupled to the inner housing, wherein the multiple seal face assembly of liquid-exuding type is adapted to be depressed downward and returned upward together with the inner housing within the outer housing; wherein the multiple seal face assembly of liquid-exuding type, the inner housing and the depressing handle are supported by the outer housing with the depressing handle projecting upward from the outer housing; wherein the outer housing is provided on its inner surface with the driving pin constituting a mechanism to rotate the multiple seal face assembly; wherein the multiple seal face assembly is provided on both side walls thereof with a plurality of driving slits each oriented radially around the central shaft and constituting also the mechanism to rotate the multiple seal face assembly; wherein the driving pin is adapted to extend through the through-hole of the inner housing into engagement with one of the driving slits as the multiple seal face assembly moves upward again from the lowest position thereof to the highest position thereof so that this engagement causes the multiple seal face assembly by one seal face; and wherein the outer housing, the inner housing and the depressing handle are molded from synthetic resin. In this way, the multiple seal faced stamp of liquid-exuding type can be supplied at a rational cost and widely accepted by the market.

The side wall of the multiple seal face assembly opposed to the side wall formed with said driving slits and the inner housing are provided with the click-stopper mechanism so that the rotation of the multiple seal face assembly can be reliably sensed.

Furthermore, the respective seal face members of the multiple seal face assembly are impregnated with different colored ink to provide a multicolored stamp.

What is claimed is:

1. A liquid-exuding multiple seal faced stamp, comprising:

an outer housing having a through-hole through the bottom thereof;

a liquid-exuding multiple seal face assembly;

a mechanism adapted to rotate said multiple seal face assembly;

an inner housing rotatably supporting the multiple seal face assembly, said inner housing having a through-hole;

an upwardly biased handle operatively coupled to the inner housing, and wherein:

said liquid-exuding multiple seal face assembly is adapted to be depressed downward and returned upward together with said inner housing within said outer housing;

said liquid-exuding multiple seal face assembly, said inner housing and said handle are supported by said outer housing with said handle projecting upward from said outer housing;

said outer housing includes a driving pin on its inner surface constituting a part of said mechanism adapted to rotate said multiple seal face assembly;

said multiple seal face assembly includes a plurality of driving slits on both side walls thereof, each slit oriented radially around a central shaft and constituting part of said mechanism to rotate said multiple seal face assembly;

said driving pin adapted to extend through said through-hole of the inner housing into engagement with one of said driving slits as the multiple seal face assembly moves upward from the lowest position thereof to the highest position thereof so that this engagement causes the multiple seal face assembly to rotate by one seal face; and wherein said outer housing, inner housing and handle are molded from synthetic resin.

2. The liquid-exuding multiple seal faced stamp of claim 1, wherein:

a side wall of said multiple seal face assembly opposed to said side wall is formed with said driving slits and the inner housing are provided with a click-stopper mechanism.

3. The liquid-exuding multiple seal faced stamp of claim 2, wherein:

the seal face members of said multiple seal face assembly are impregnated with different colored ink so that the stamp can be used as a multicolored stamp.

4. A liquid-exuding multiple seal faced stamp comprising:

an outer housing molded from synthetic resin and having an opening at the bottom thereof;

a multiple seal face assembly movably supported by said outer housing for movement between an upper position and a lower position:

an inner housing molded from synthetic resin and rotatably supporting the multiple seal face assembly and including a through-hole;

an upwardly biased handle operatively coupled to the inner housing, and wherein:

a mechanism adapted to rotate said multiple seal face assembly by one seal face as the multiple seal face assembly moves upward from said lower position to said upper position; and said multiple seal face assembly including a plurality of driving slits on both side walls thereof, each slit oriented radially around a central shaft and constituting part of said mechanism to rotate said multiple seal face assembly; and wherein:

said outer housing includes a driving pin on its inner surface constituting a part of said mechanism, said driving pin adapted to extend through said through-hole of the inner housing into engagement with one of said driving slits to rotate said multiple seal face assembly by one seal face as the multiple seal face assembly moves upward from said lower position to said upper position.

5. The liquid-exuding multiple seal faced stamp of claim 4, wherein:

said handle is molded from synthetic resin.

6. The liquid-exuding multiple seal faced stamp of claim 5, wherein:

a side wall of said multiple seal face assembly opposed to said side wall is formed with said driving slits and the inner housing are provided with a click-stopper mechanism.

7. The liquid-exuding multiple seal faced stamp of claim 6, wherein:

the seal faces of said multiple seal face assembly are impregnated with different colored ink so that the stamp can be used as a multicolored stamp.

* * * * *